US012571136B2

(12) United States Patent
Blich et al.

(10) Patent No.: US 12,571,136 B2
(45) Date of Patent: Mar. 10, 2026

(54) NET

(71) Applicant: TAMA GROUP, Kibbutz Mishmar Haemek (IL)

(72) Inventors: Uri Blich, Kibbutz Mishmar Haemek (IL); Rotem Eitan, Kibbutz Mishmar Haemek (IL)

(73) Assignee: TAMA GROUP, Kibbutz Mishmar Haemek (IL)

( * ) Notice: Subject to any disclaimer, the term of this patent is extended or adjusted under 35 U.S.C. 154(b) by 1055 days.

(21) Appl. No.: 17/620,719

(22) PCT Filed: Jun. 21, 2020

(86) PCT No.: PCT/IL2020/050689
§ 371 (c)(1),
(2) Date: Dec. 19, 2021

(87) PCT Pub. No.: WO2020/255146
PCT Pub. Date: Dec. 24, 2020

(65) Prior Publication Data

US 2022/0325444 A1 Oct. 13, 2022

Related U.S. Application Data

(60) Provisional application No. 62/863,909, filed on Jun. 20, 2019.

(51) Int. Cl.
*D03D 9/00* (2006.01)
*D03D 15/37* (2021.01)

(52) U.S. Cl.
CPC ..... *D03D 9/00* (2013.01); *D03D 15/37* (2021.01)

(58) Field of Classification Search
CPC ..... B29D 28/00; D03D 9/00; D03D 15/37; A01K 77/00; A01K 74/00; A01K 75/00
(Continued)

(56) References Cited

U.S. PATENT DOCUMENTS 3,011,820 A 12/1961 Frieder et al.
3,674,583 A 7/1972 Allport
(Continued)

FOREIGN PATENT DOCUMENTS

CN 2910977 Y 6/2007
EP 1853460 A1 11/2007
(Continued)

OTHER PUBLICATIONS

Pallet Wrap, NDicatorTM New Technology, by Tama. (May 28, 2020). NDicatorTM Pallet Wrap | Pallet Wrap | NDicatorTM New Technology | by Tama. Pallet Wrap | NDicatorTM New Technology | by Tama | The Original and Most Advanced Elastic Knitted Pallet Netting. https://www.ndicator-pallet-net.net/.
(Continued)

*Primary Examiner* — Camie S Thompson
(74) *Attorney, Agent, or Firm* — The Roy Gross Law Firm, LLC; Roy D. Gross

(57) ABSTRACT

A net including a plurality of transverse bands, intersecting a plurality of longitudinal bands, the plurality of longitudinal bands each comprising two intermittently adhered films forming channels at discontinuities of adhesion between the films, and wherein at least one intersection of the longitudinal and transverse bands at least one transverse band is threaded through at least one of the channels of at least one longitudinal band.

20 Claims, 5 Drawing Sheets

(58) Field of Classification Search
USPC ..... 442/4; 294/77
See application file for complete search history.

(56) References Cited

U.S. PATENT DOCUMENTS

| | | | |
|---|---|---|---|
| 3,961,585 | A | 6/1976 | Brewer |
| 9,339,986 | B2 | 5/2016 | Frei et al. |
| 9,574,289 | B2 | 2/2017 | Lieber et al. |
| 10,208,409 | B2 | 2/2019 | Lieber et al. |
| 10,253,438 | B2 | 4/2019 | De Graaf et al. |
| 2003/0224141 | A1 | 12/2003 | Maupetit et al. |

FOREIGN PATENT DOCUMENTS

| | | | |
|---|---|---|---|
| EP | 2666922 | B1 | 7/2015 |
| GB | 310708 | A | 5/1929 |
| GB | 870798 | A | 6/1961 |
| GB | 2120294 | A | 11/1983 |
| GB | 2314802 | A | 1/1998 |
| JP | S46-009581 | | 4/1971 |
| KR | 20060028669 | A | 3/2006 |
| KR | 20100039665 | A | 4/2010 |
| KR | 20130008294 | A | 1/2013 |
| NL | 2011328 | C2 | 2/2015 |
| RU | 2664268 | C2 | 8/2018 |
| WO | 2001031105 | A1 | 5/2001 |
| WO | 2015097466 | A | 7/2015 |

OTHER PUBLICATIONS

PCT International Search Report for International Application No. PCT/IL2020/050689, mailed Oct. 22, 2020, 3pp.

PCT Written Opinion for International Application No. PCT/IL2020/050689, mailed Oct. 22, 2020, 7pp.

PCT International Preliminary Report on Patentability for International Application No. PCT/IL2020/050689, issued Dec. 21, 2021, 8pp.

Office Action in Indian Application No/ 202217002354 dated Nov. 18, 2025 9 pages.

NET

CROSS-REFERENCE TO RELATED APPLICATIONS

This application is a National Phase of PCT Patent Application No. PCT/IL2020/050689 having International filing date of Jun. 21, 2020, entitled "A NET" which claims the benefit of priority of U.S. provisional patent application No. 62/863,909 filed Jun. 20, 2019, and entitled "NET," the contents of which are all incorporated herein by reference in their entirety.

FIELD OF THE INVENTION

The present invention, in some embodiments thereof, relates to a net and, more particularly, but not exclusively, to an adjustable net.

BACKGROUND

Commonly used nets have a flat two-dimensional shape which can be folded and glued together to form a three-dimensional shape. Nets are often used for packaging items, point of sale display units, tissue boxes, wrapping, coating, barriers and so on.

Commonly used nets can provide protection to an element at least partially surrounded by the net, while supporting the element. For example, nets are used to wrap solid products of all sorts. Nets are used for transporting various products in a safe and a stable manner. Some commonly used nets are used in packing, and medical treatments which require air to pass through the apertures of the net.

SUMMARY

The following embodiments and aspects thereof are described and illustrated in conjunction with systems, tools and methods which are meant to be exemplary and illustrative, not limiting in scope.

In accordance with an aspect some embodiments, there is provided a net including a plurality of transverse bands, intersecting a plurality of longitudinal bands, wherein each longitudinal band of the plurality of longitudinal bands includes two intermittently adhered films forming channels at discontinuities of adhesion between the films, and wherein at an intersection of a longitudinal band and a transverse band a transverse band is threaded through a channel in said longitudinal band.

According to some embodiments, at least one channel of the channels includes a semi-adhered zone, a non-adhered zone, a friction zone or a combination thereof between the channel and the transverse bands. In some embodiments, at least one channel of the channels is configured to impede movement of the transverse band through the channel. In some embodiments, at least two of a plurality of transverse bands are threaded through channels of at least two of a plurality of the longitudinal bands and forming four intersections between the longitudinal bands and the transverse bands.

In some embodiments, the strength of the adhesion between the transverse band and the films in the intersection is at least 30% weaker than the adhesion between the films. In some embodiments, the channel includes inner surfaces facing each other and wherein the transverse band occupies 20 to 90% of a surface area of the inner surfaces. In some embodiments, the ratio between a surface area of adhered portions of the films to a surface area of the films at the channel is at least 3:1.

In some embodiments, a position and/or orientation of the transverse band in relation to the longitudinal band at the channel is adjustable. In some embodiments, a location of the point of intersection between the longitudinal band and the transverse band is adjustable along the length of at least one of the longitudinal bands and/or the transverse bands. In some embodiments, adjustability of the net is independent of the elasticity of the transverse bands and the longitudinal bands.

In accordance with an aspect of some embodiments of the invention there is provided a net, including a plurality of transverse bands, intersecting a plurality of longitudinal bands, wherein each longitudinal band of the plurality of longitudinal bands includes two intermittently adhered films forming channels at discontinuities of adhesion between the films, and wherein at an intersection of a longitudinal band and a transverse band a transverse band is threaded through a channel in said longitudinal band, wherein the at least one channel of the channels is configured to impede movement of the at least one transverse band threaded therethrough, and wherein the adhesion between each film of the films within the channel and the transverse band is at least 30% weaker than the adhesion between the adhered films.

According to some embodiments, the adhesion within at least one channel of the channels includes: a semi-adhered zone, non-adhered, a friction zone or a combination thereof between the films. In some embodiments, at least two of a plurality of transverse bands are threaded through channels of at least two of a plurality of the longitudinal bands and forming four intersections between the longitudinal bands and the transverse bands. In some embodiments, the channel includes inner surfaces facing each other and wherein the transverse band occupies 20 to 90% of a surface area of the inner surfaces. In some embodiments, the ratio between a surface area of adhered portions of the films to a surface area of the films at the channel is at least 3:1.

In some embodiments, a position and/or orientation of the transverse band in relation to the longitudinal band at the channel is adjustable. In some embodiments, a location of the point of intersection between the longitudinal band and the transverse band is adjustable along the length of at least one of the longitudinal bands and/or the transverse bands. In some embodiments, adjustability of the net is independent of the elasticity of the transverse bands and the longitudinal bands. In some embodiments, the transverse band further crosses an edge longitudinal band in a serpentine or zigzag manner. In some embodiments, the transverse band crosses the edge longitudinal band of the net and forms a semi-loop at one net's longitudinal edge, another net's longitudinal edge, or both. In some embodiments, the semi-loop extends beyond the one net's longitudinal edge, another net's longitudinal edge, or both. In some embodiments, the length (L) of the semi-loop corresponds to a predetermined distance (D) between the intersection of the semi-loop and the edge longitudinal band, at one net's longitudinal edge, another net's longitudinal edge, or both. In some embodiments, two adjacent segments of the transverse band threaded through at least one edge longitudinal band and define between them a semi-loop locking portion of the longitudinal band's edge. In some embodiments, the ratio between an area (a) of said locking portion exclusive of the channels and an area (b) inclusive of the channels is expressed by ($0.1b \geq a$).

According to some embodiments, provided herein is a net, comprising: a plurality of longitudinal bands; intersecting, at least one transverse band, wherein each longitudinal band of said plurality of longitudinal bands comprises two intermittently adhered films forming channels at discontinuities of adhesion between the films; and wherein at an intersection of a longitudinal band and the transverse band, the transverse band is threaded through at least one channel in the longitudinal band, wherein the transverse band crosses at least a portion of said plurality of longitudinal bands in a serpentine or zigzag manner. the transverse band crosses the edge longitudinal band of the net and forms a semi-loop at one net's longitudinal edge, another net's longitudinal edge, or both. In some embodiments, the semi-loops extend beyond one net's longitudinal edge, another net's longitudinal edge, or both. In some embodiments, the length (L) of the semi-loop corresponds to a predetermined distance (D) between the intersection of the semi-loop and at least one longitudinal band at one net's longitudinal edge, another net's longitudinal edge, or both. In some embodiments, two adjacent segments of the transverse band threaded through the edge longitudinal band, define between them the semi-loop locking portion of said longitudinal band.

In addition to the exemplary aspects and embodiments described above, further aspects and embodiments will become apparent by reference to the figures and by study of the following detailed description.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

Figure 1:
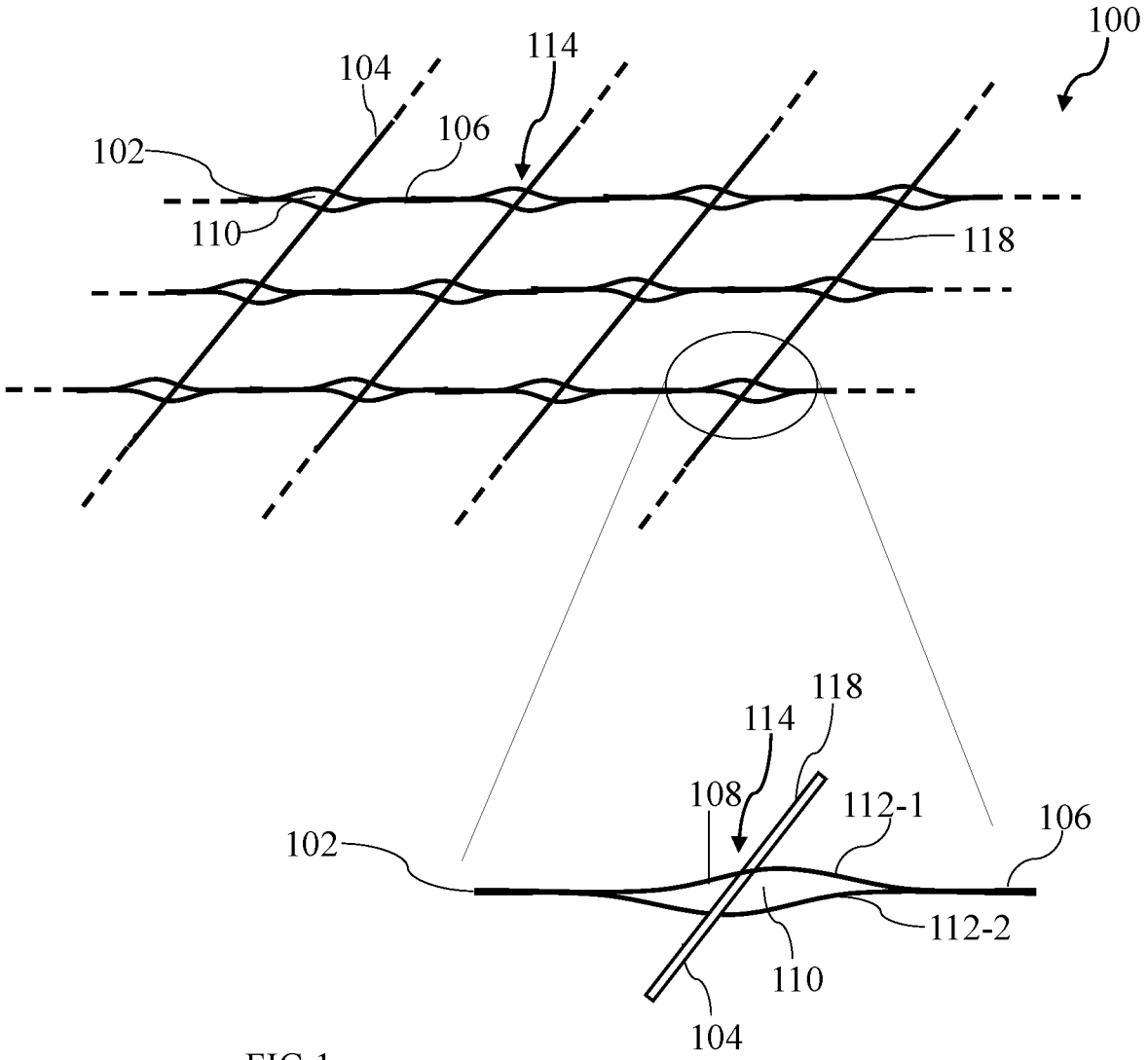
FIG. 1 is a perspective view simplified illustration of an embodiment of a net in accordance with some embodiments of the present invention.

According to some embodiments of the present invention there is provided a net which comprises adjustable intersections 114. In some embodiments, the net comprises a plurality of transverse bands and a plurality of longitudinal bands. In some embodiments, each longitudinal band comprises two intermittently adhered films. In some embodiments, the adhered segments of the intermittently adhered films are non-reversibly adhered. In some embodiments, the non-adhered portions of the films form channels between the films. In some embodiments, the transverse band is threaded through the channels. In some embodiments, the non-adhered portions of the films impede the movement of the transverse band threaded therethrough. In some embodiments, the dimensions and physical properties of the channel and/or the transverse band determine the adjustability i.e., geometric deformation, of the transverse band within the channels.

According to an aspect of some embodiments of the present invention there is provided a net comprising longitudinal bands and transverse bands wherein the longitudinal bands comprise channels wherein the transverse bands are threaded through the channels. In some embodiments, the channels are at least partially adhered to the transverse bands that are threaded therethrough. In some embodiments, the adhesion (weaker adhesion of intersecting bands) between the transverse band and the films at the channel also referred to as junction, intersection or crossing is at least 30% weaker than the adhesion between the films at the adhered portion. In some embodiments, the adhesion between the transverse band and the films at the channel also referred to as junction, intersection or crossing reversal-adhesion. In some embodiments, the adhesion of the longitudinal bands to the transverse bands is formed at least in part by one or more of bonding (e.g., heat bonding, adhesive bonding, gluing or similar), welding, chemical adhesion or any combination thereof. In some embodiments, the adhesion (strong adhesion of intersecting bands) of a longitudinal band's edge to a transverse band is formed by heat bonding, welding, chemical adhesion or any combination thereof, this adhesion at the edge of a longitudinal band is at least twice, 3 times, 4 times, 5 times, 6 times, 8 times or 10 times, stronger than the adhesion at the junction. In one embodiment, longitudinal band's edge is 0.01 to 5 cm long at an end of longitudinal band. In some embodiments, strong adhesion of intersecting bands is performed only in a longitudinal band situated or located at a longitudinal edge of the net.

According to an aspect of some embodiments of the present invention there is provided a net comprising transverse and longitudinal bands wherein the adjustability of the net is independent of the elasticity of the transverse and longitudinal bands. In some embodiments, the net comprises adjustable shape of two-dimensional and three-dimensional geometries. In some embodiments, the transverse band is threaded through the channel of the longitudinal band to form a reticulate structure. In some embodiments, the adjustability of the longitudinal band and the transverse band in relation to each other at the intersections 114 comprises shiftable locations of the intersection along the length of the transverse band, angles between the transverse band and the longitudinal band at the intersection, and lengths of the transverse band between intersections 114.

In one embodiment, a longitudinal band comprises an edge longitudinal band. In one embodiment, an edge longitudinal band is positioned at a longitudinal edge or end of the net. In one embodiment, a longitudinal edge or end of the net comprises at least one longitudinal band or at least one edge longitudinal band. In one embodiment, each of the net's longitudinal edge or end comprises 1 to 10 longitudinal bands/edge longitudinal bands. In one embodiment, each of the net's longitudinal edge comprises 1 to 6 longitudinal bands/edge longitudinal bands. In one embodiment, each of the net's longitudinal edge consists 1 longitudinal band/edge longitudinal band. In one embodiment, each of the net's longitudinal edge comprises 2 to 4 longitudinal bands/edge longitudinal bands.

In one embodiment, a transverse band further crosses an edge longitudinal band in a serpentine or zigzag manner. In one embodiment, a transverse band crosses an edge longitudinal band of the net and forms a semi-loop at one longitudinal edge of the net, another edge longitudinal of the net, or both. In one embodiment, the semi-loop extends beyond one edge of the net, another edge of the net, or both.

In one embodiment, a length (L) of the semi-loop corresponds to a predetermined distance (D) between an intersection of the semi-loop and at least one longitudinal band or an edge longitudinal band at one edge of the net, another edge of the net, or both.

In one embodiment, at least two adjacent segments of a transverse band threaded through at least one edge longitudinal band define between them a semi-loop locking portion of a longitudinal band or an edge longitudinal band (at the net's longitudinal edge). In one embodiment, the ratio between an area (a) of the locking portion exclusive of the channels and an area (b) inclusive of said channels is expressed by ($0.1b \geq a$).

In one embodiment, provided herein is a net, comprising: a plurality of transverse bands; and a plurality of longitudinal bands; wherein each longitudinal band of said longitudinal bands comprises two films, each longitudinal band comprises at least two adhered portions and a non-adhered portion therebetween forming a channel. In some embodiments, the channel is an opening formed between the films and/or at least partial discontinuity in the adhesion of the films between two adhered portions.

In some embodiments, each adhered portion of said adhered portions ends with a channel; wherein the channel (and/or non-adhered portion) comprises a semi-adhered zone, a non-adhered zone or both wherein each transverse band of at least 50% of the transverse bands is threaded through the channel forming an intersection between the longitudinal band and the transverse band. In one embodiment, one transverse band is threaded in at least two channels, wherein each channel of at least two channels is on a different longitudinal band. In one embodiment, at least one transverse band is threaded in at least two channels, wherein each channel of at least two channels is on a different longitudinal band.

In one embodiment, a semi-adhered zone, a non-adhered zone or both, is present only in a channel. In one embodiment, a semi-adhered zone, a non-adhered zone or both, is present only in a longitudinal band. In one embodiment, a semi-adhered zone is a zone wherein the films are loosely adhered to one another. In one embodiment, a semi-adhered zone is a zone wherein each one of the films is loosely adhered to a transverse band. In one embodiment, a non-adhered zone is a zone wherein the films are not adhered to one another. In one embodiment, a non-adhered zone is a zone wherein each one of the films is not adhered to a transverse band.

In one embodiment, the two films are glued to each other. In one embodiment, each film of the two films comprises two sides, wherein one side is sticky or comprises a glue and the other side is non-sticky or devoid of glue. In one embodiment, the sticky side or the glue comprising side of each film of the two films are in contact within an adhered portion of the adhered portions. In one embodiment, the sticky side or the glue comprising side of each film of the two films are in contact the transverse band within the channel. In one embodiment, the transverse band is devoid of glue or a sticky side. In one embodiment, the transverse band comprises a single film devoid of a glue or a sticky side. In one embodiment, the longitudinal band comprises two film wherein each film has two sides (or surfaces) wherein one side or surface is devoid of a glue or a sticky side and the second side or surface comprises a glue or a sticky side.

In one embodiment, a tape comprises a pressure-sensitive adhesive. In one embodiment, a tape comprises fiberglass filaments. In one embodiment, a tape is a filament tape. In one embodiment, a tape comprises a pressure-sensitive adhesive coated onto a polypropylene or polyester film and fiberglass filaments embedded within. In one embodiment, a tape is comprised of liquid rubber. In one embodiment, a tape comprises ethylene propylene rubber (EPR). In one embodiment, a tape comprises polyisobutylene.

In one embodiment, a tape is a friction tape. In one embodiment, a tape comprises an adhesive is impregnated onto it. In one embodiment, the adhesive is a rubber-based adhesive. In one embodiment, a tape is a self-amalgamating tape. In one embodiment, a tape is a non-tacky tape.

In one embodiment, a tape comprises a pressure-sensitive adhesive coated onto one side of the tape. In one embodiment, a pressure-sensitive adhesive is coated onto the tape wherein the tape is composed of a polypropylene or a polyester film. In one embodiment, a tape has strength in both the long (machine) direction and the cross direction. In one embodiment, a tape comprises an adhesive. In one embodiment, a tape comprises an acrylic adhesive. In one embodiment, the term "adhesive" and "glue" are used interchangeably.

In one embodiment, a tape comprises strip of thin plastic material. In one embodiment, a tape comprises latex. In one embodiment, a tape adheres only to itself or to another identical tape. In one embodiment, a tape is a cloth- or scrim-backed pressure-sensitive tape. In one embodiment, a tape is coated with polyethylene.

In one embodiment, "loosely adhered" is an adherence between two films having a strength, a bonding strength, adhesive power, cohesive power or any combination thereof which is at least 20%, 30%, 40%, 50%, 60%, 70%, 80%, or 90% less than the adherence the strength, the bonding strength, the adhesive power, the cohesive power or any combination thereof between two films within the adhered portion of a longitudinal band.

In one embodiment, provided herein is a net, comprising: a plurality of transverse bands; and a plurality of longitudinal bands. In one embodiment, each longitudinal band of the longitudinal bands comprises two films. In one embodiment, each longitudinal band comprises at least two adhered portions. In one embodiment, an adhered portion is a portion, or an area characterized by adhesion between the two films. In one embodiment, each adhered portion borders one channel or two of channels.

In one embodiment, each channel of the channels comprises at least partial adhesion between the two films or between each film and the transverse band. In one embodiment, each channel of the channels comprises no adhesion between the two films or between each film and the transverse band. In one embodiment, each channel is configured to accommodate at least a portion of a transverse band between the films.

In one embodiment, each transverse band of at least 40%, 50%, 60%, 70%, 80%, 90% or all of the transverse bands is threaded through each channel of the channels. In one embodiment, a transverse band threaded through a channel forms an intersection between the longitudinal band and said transverse band. In one embodiment, the strength of the adherence, the bonding strength, the adhesive power, the cohesive power or any combination thereof between the transverse band and the channel at the intersection is at least 30% weaker than the strength of the adherence, the bonding strength, the adhesive power, the cohesive power or any combination thereof between the two films at the adhered portion/s.

In one embodiment, the transverse band occupies 90%, 80%, 75%, 70%, 60% or 50% or less of the channel area. In one embodiment, "the transverse band occupies" is synonymous with a transverse section of the transverse band.

In one embodiment, the ratio between the surface area of the adhered portions to the surface area of the channel is at least 2:1. In one embodiment, the ratio between the surface area of the adhered portions to the surface are of the channel is at least 2.5:1. In one embodiment, the ratio between the surface area of the adhered portions to the surface area of the channel is at least 3:1. In one embodiment, the ratio between the surface area of the adhered portions to the surface area of the channel is at least 4:1. In one embodiment, the ratio between the surface area of the adhered portions to the surface area of the channel is at least 5:1.

In one embodiment, the ratio between the surface area of the adhered portions to the surface area of the channel is between 1.5:1 to 100:1. In one embodiment, the ratio between the surface area of the adhered portions to the surface area of the channel is between 1.5:1 to 75:1. In one embodiment, the ratio between the surface area of the adhered portions to the surface area of the channel is between 2:1 to 50:1. In one embodiment, the ratio between the surface area of the adhered portions to the surface area of the channel is between 4:1 to 50:1.

In one embodiment, the transverse band is moveable within the channel. In one embodiment, the transverse band is translocatable within the channel. In one embodiment, the transverse band is moveable along the length of the channel, along the width of the channel or both. In one embodiment, the transverse band is translocatable within the length of the channel, the width of the channel or both.

In one embodiment, the orientation of the transverse band in relation to the longitudinal is adjustable. In one embodiment, the orientation of the transverse band in relation to the longitudinal within a channel is adjustable. In one embodiment, the angle between a transverse band and a longitudinal band with a channel is adjustable. In one embodiment, the intersection and or the channel is/are moveable and/or relocatable.

In one embodiment, the net is an adjustable net, which is a deformable structure composed of elements which can be non-deformable, rigid, semi-rigid, and/or elastic, and the like, such that the adjustability of the structure of the net 100 is formed at least partially by the adjustable orientation and/or position of the elements in relation to one another. In one embodiment, a net as described herein is stretchable.

In one embodiment, a net as described herein is stretchable by at least 1.5 of its initial length and/or width. In some embodiments, the net is stretchable by at least 1.2 of its initial length. In some embodiments, the net is stretchable by at least 1.7 of its initial length. In some embodiments, the net is stretchable by at least 1.2 of its initial width. In some embodiments, the net is stretchable by at least 1.5 of its initial width. In some embodiments, the net is stretchable by at least 1.7 of its initial width.

Reference is made to FIG. 1, which is a perspective view of an exemplary embodiment of a net in accordance with some embodiments of the present invention. In some embodiments, the net 100 comprises a plurality of longitudinal bands 102. In some embodiments, the net 100 comprises a plurality of transverse bands 104. In some embodiments, the longitudinal band 102 comprises at least one channel 110 formed between two or more films 112. In some embodiments, the transverse band 104 is threaded between the films 112 and/or through the channel 110.

In some embodiments, a longitudinal band 102 comprises at least one channel 110. In some embodiments, each longitudinal band 102 comprises at least two channels 110. In some embodiments, at least one transverse band 104 is threaded through each channel 110. In some embodiments, one transverse band 104 is threaded through each channel 110. In some embodiments, a plurality of transverse bands 104 are threaded through each channel 110.

In some embodiments, the elements of the net 100, as described in greater detail elsewhere herein, are the longitudinal band 102 and/or the transverse band 104. In some embodiments, the intersection 114 of the transverse band 104 and the longitudinal band 102 is shiftable along the length of at least one of the transverse bands 104 and the longitudinal band 102. In some embodiments, the net 100 is deformable, for example, by adjusting the position and/or orientation of the transverse band 104 within the channels 110.

A potential advantage in adjustable intersections 114 is in that a geometry of the net 100 is adjustable independently of the elasticity of the transverse and longitudinal bands 104/102.

A potential advantage of the adjustability of the longitudinal band 102 and the transverse band 104 in relation to each other at the intersections 114 is in that the adjustability of the structure of the net 100 is increased by establishing a range of positions and/or orientations of the transverse band 104 in relation to the longitudinal band 102. In some embodiments, the adjustability of the net 100 is independent of the elasticity of the transverse bands 104 and said longitudinal bands 102.

Longitudinal Band

In some embodiments, the longitudinal band 102 is composed of two films 112-1 and 112-2, collectively referred to as films 112. In some embodiments, the films 112 comprise a cord, a wire, a belt, film, a thread, and the like. In some embodiments, the films 112 comprise tapes. In some embodiments, the longitudinal band 102 comprises two layered films 112. In some embodiments, the films 112 are similar in shape and size. In some embodiments, and as described in greater detail elsewhere herein, the films 112 are at least partially adhered to each other.

In some embodiments, the films 112 comprise inner surfaces (e.g., inner surfaces 122-1 and 122-2, collectively referred to as inner surfaces 122) which are facing each other. In some embodiments, the inner surfaces 122 of the films 112 are adhered at at least two adhered portions 106 along the longitudinal band 102. In some embodiments, a portion of the inner surfaces 122 are sticky at least at the adhered portions 106 of the longitudinal band 102. In some embodiments, the inner surfaces of the films 112 comprise an adhesive. For example, in some embodiments, such as the exemplary embodiment depicted by FIG. 1, the longitudinal band 102 comprises two films 112 stuck to each other.

In some embodiments, the films 112 are touching, adhered, coupled, bound, glued, connected, joining, bordering, attached, bonded, or any combination thereof.

In some embodiments, the longitudinal band 102 is flexible, semi-rigid, rigid, elastic, deformable, ductile, stretchable, and the like. In some embodiments, the longitudinal band 102 is composed of materials such as steels, polymers, alloys, polyethylene, plastics, elastic polymers, metals, or any combination thereof.

In some embodiments, the width of the longitudinal band 102 is 1-150 mm. In some embodiments, the width of the longitudinal band 102 is 10-50 mm. In some embodiments, the width of the longitudinal band is 15-25 mm. In some embodiments the width of the longitudinal band 102 constant. In some embodiments, the width of the longitudinal band 102 varies.

In one embodiment, a tape's width is from 2 mm to 150 mm. In one embodiment, a tape's width is from 5 mm to 75 mm. In one embodiment, a tape's width is from 10 mm to 75 mm. In one embodiment, a tape's width is from 10 mm to 50 mm. In one embodiment, a tape's width is from 15 mm to 45 mm. In one embodiment, both tapes of the two tapes have the same width. In one embodiment, both tapes of the two tapes have the same length. In one embodiment, both tapes of the two tapes have the same thickness. In one embodiment, both tapes of the two tapes and the longitudinal band have the same width. In one embodiment, both tapes of the two tapes and the longitudinal band 102 have the same length.

In one embodiment, the tape's thickness is 0.02 to 1 mm. In one embodiment, the tape's thickness is 0.05 to 1 mm. In one embodiment, the tape's thickness is 0.05 to 0.5 mm. In one embodiment, the tape's thickness is 0.06 to 0.8 mm. In one embodiment, the tape's thickness is 0.08 to 0.5 mm.

In one embodiment, the longitudinal band's 102 thickness is 0.03 to 2 mm. In one embodiment, the longitudinal band's thickness is 0.05 to 1.8 mm. In one embodiment, the longitudinal band's thickness is 0.1 to 1 mm. In one embodiment, the longitudinal band's 102 thickness is 0.12 to 1.8 mm. In one embodiment, the longitudinal band's 102 thickness is 0.16 to 1.2 mm. In some embodiments, the longitudinal band 102 comprises at least two adhered portions 106 in which the films 112 are adhered. In some embodiments, the adhered portions 106 confine a channel 110 between thereof.

Adhered Portion

In some embodiments, the total surface area of the adhered portions 106 is at least 50%, 60%, 70%, 80%, or 90% of the total surface area of the longitudinal band 102, or any value and range therebetween.

In some embodiments, the length of the adhered portion 106 along the length of the longitudinal band 102 is 0.5-150 mm. In some embodiments, the length of the adhered portion 106 is 0.5-75 mm. In some embodiments, the length of the adhered portion 106 is 1-25 mm. In some embodiments, the length of the adhered portion 106 is 1-13 mm. In some embodiments, the length of the adhered portion 106 is 1-7 mm.

In some embodiments, each longitudinal band 102 comprises adhered portions 106 of equal lengths. In some embodiments, the length of the adhered portions 106 vary along each individual longitudinal band 102.

In some embodiments, and as described in greater detail elsewhere herein, the film 112 comprises a tape. In some embodiments, and as described in greater detail elsewhere herein, the tape comprises one or more of a filament tape, a friction tape, a self-amalgamating tape, which comprise adhesion properties such as bonding strength and/or friction.

Channel

In some embodiments, the longitudinal band 102 comprises a plurality of channels 110. In some embodiments, the channel 110 is shaped to accommodate the transverse band 104 through the channel 110. In some embodiments, the channels 110 are formed by discontinuities in the intermittent adhesion of the longitudinal band 102. In some embodiments, at least 50% of the adhered portions 106 within a net 100 as described herein each confine at least two channels 110. In some embodiments, at least 60% to 80% of the adhered portions 106 within a net 100 each confine at least two channels 110.

In some embodiments, the channel 110 between two films 112 of the longitudinal band 102 comprises an opening, a partial opening, a partial adhesion, and/or no adhesion between the films 112. In some embodiments, opening comprises a gap, slot, and/or discontinuity of the adhesion between two films 112. In some embodiments, and as described in greater detail elsewhere herein, the channel 110 comprises a semi-adhered zone, a non-adhered zone or both. In some embodiments, the channel 110 houses the transverse band 104.

In one embodiment, a semi-adhered zone comprises one or more of a zone wherein the films 112 are loosely adhered to one another and a zone wherein at least one film 112 is loosely adhered to the transverse band 104. For example, in some embodiments, the loosely adhered films 112 comprise an adhesive wherein the strength of the adhesive is weaker than the strength of the adhesion between the films 112 at the adhered portions 106. For example, in some embodiments, the loosely adhered films 112 comprise surfaces which have frictional interaction with each other and/or with the transverse band 104.

For example, in some embodiments, the loosely adhered film 112 and transverse band 104 comprise an adhesive wherein the strength of the adhesive is weaker than the strength of the adhesion between the films 112 at the adhered portions 106.

In some embodiments, the semi-adhered zone comprises adhesion which is at least 30%, 40%, 50%, 60%, 70%, 80%, or 99% weaker than the adhesion between the films 112 of the longitudinal band 102, or any value or range therebetween.

In some embodiments, the non-adhered zone comprises a zone wherein one or both of the films 112 are not adhered to the transverse band 104, and/or the films 112 are not adhered to one another.

In some embodiments, the channel 110 houses the transverse band 104. In some embodiments, the channel 110 houses the 1-3 transverse bands 104. In some embodiments, the channel 110 is adapted to provide an opening which houses the transverse band 104. In some embodiments, the channel 110 is adapted to provide an opening which houses the transverse band 104 and an area of 20 to 200% of the width of the transverse band 104. In some embodiments, the channel 110 is adapted to provide an opening which houses the transverse band 104 and an area of 30% to 150% of the width of the transverse band 104. In some embodiments, the channel 110 is adapted to provide an opening which houses the transverse band 104 and an area of 40% to 100% of the width of the transverse band 104.

In some embodiments, the ratio between the surface area of the outer surface of the films 112 at the adhered portion 106 and the surface area of the outer surface of the films 112 at the channel 110 is 8:1, 6:1, 4:1, or 2:1, or any value and range therebetween. For example, in the exemplary embodiment depicted by FIG. 1, the ratio between the surface area of the outer surface of the films 112 at the adhered portion 106 and the surface area of the outer surface of the films 112 at the channel 110 is 3:1. In some embodiments, the width of the films 112 at the adhered portion 106 is equal to the width of the films 112 at the channel 110.

In some embodiments, the width of the channel 110 is defined as a distance across the channel 110 which is parallel to the length of the longitudinal band 102. In some embodiments, the channel 110 is at least 2 mm wider than the transverse band 104. In some embodiments, the channel 110 is at least 5 mm wider than the transverse band 104. In some embodiments, the width of the channel 110 is 1-20 mm larger than the width of the transverse band 104.

In some embodiments, the width of the channel 110 is 5-10 mm larger than the width of the transverse band 104. In some embodiments, the width of the channel 110 is 1-5 mm larger than the width of the transverse band 104. In some embodiments, the width of the channel 110 is constant. In some embodiments, the width of the channel 110 varies. In some embodiments, the difference between the width of the channel 110 and the width of the transverse band 104 defines the range of distance in which the transverse band 104 is can adjust within the channel 110.

A potential advantage of the width of the channel 110 being larger than the width of the transverse band 104 is in that the position and/or orientation of the transverse band 104 is adjustable within the channel 110, which increases the adjustability of the structure of the net 100 independently form the elasticity of the longitudinal band 102 and/or transverse band 104.

A potential advantage of the longitudinal band 102 comprising a channel 110 is in that the surfaces of the transverse band can remain parallel to the surfaces of the longitudinal band within the channel 110, which maintains the net 100 flat. A flat net 100 can be rolled onto a roller during unpacking and/or for efficient storage.

A potential advantage of the films 112 having a stronger adhesion than the adhesion within the channel 110 is in that the dimensions of the adhered portions 106 and/or channels 110 of the longitudinal band 102 are not altered by forces applied to the net 100. In some embodiments, the adherence of the films 112 prevents external forces applied onto the longitudinal band 102 from deforming the channel 110. In some embodiments, the adherence of the films 112 prevents external forces applied onto the transverse band 104 from deforming the channel 110.

Transverse Band

In some embodiments, the transverse band 104 comprises a cord, a wire, a belt, a film, a thread, and the like. In some embodiments, the transverse band 104 comprises at least a portion having dimensions sufficient to fit within the channel 110 of the longitudinal band 102.

In some embodiments, the transverse band 104 is flexible, semi-rigid, rigid, elastic, deformable, stretchable, ductile, and the like. For example, in some embodiments, the transverse band 104 is composed of materials such as steels, polymers, alloys, metals, polyethylene, plastics, elastic polymers, or any combination thereof.

In some embodiments, the thickness of the transverse band 104 is 0.03 to 2 mm. In some embodiments, the thickness of the transverse band 104 is 0.05-1.8 mm. In some embodiments, the thickness of the transverse band 104 is 0.1-1 mm. In some embodiments, the thickness of the transverse band 104 is 0.12-1.8 mm. In some embodiments, the thickness of the transverse band 104 is 0.04-1.3 mm. In some embodiments, the thickness of the transverse band 104 is constant. In some embodiments, the thickness of the transverse band 104 varies.

In some embodiments, the thickness of the transverse band 104 is smaller than or equal to the height of the opening of channel 110. In some embodiments, the thickness of the transverse band 104 is sufficient to fit within the opening of channel 110 such that the transverse band 104 abuts against both of the films 112 of the channel 110.

In some embodiments, the width of the transverse band 104 is shorter than the width of the channel 110. In some embodiments, the width of the transverse band 104 is 1-50 mm. In some embodiments, the width of the transverse band 104 is 0.2-30 mm. In some embodiments, the width of the transverse band 104 is 0.5-15 mm. In some embodiments, the width of the transverse band 104 is 3-17 mm. In some embodiments the width of the transverse band 104 constant. In some embodiments, the width of the transverse band 104 varies.

In some embodiments, the transverse band 104 folds within the channel 110, such that the width of the transverse band 104 within the channel 110 is smaller than a flattened transverse band 104.

In some embodiments, the transverse band 104 occupies 90% or less of the channel 110 area. In some embodiments, the transverse band 104 occupies 70% or less of the channel 110 area. In some embodiments, the transverse band 104 occupies 60-99% of the channel 110 area. In some embodiments, the transverse band 104 occupies 20-65% of the channel 110 area.

In some embodiments, the transverse band comprises a portion within the channel 110 and an outer portion 118 which remains outside of the channel 110. In some embodiments, the dimensions of the outer portion 118 are larger than then dimensions of the channel 110 (as described in greater detail elsewhere herein and depicted by FIG. 2B). For example, in some embodiments, the width of the outer portion 118 larger than the width of the channel 110. In some embodiments, the outer portion 118 is sized and positioned such that the transverse band 104 has limited mobility along the longitudinal axis of the transverse band 104. In some embodiments, the motion of the transverse band 104 within the channel 110 is limited by the portion 118.

In some embodiments, the transverse band 104 comprises the outer portion 118 at one side or both sides of the channel 110, such that movement of the transverse band 104 is limited within the channel 110. In some embodiments, the transverse band 104 comprises at least one outer portion 118 at at least one side of the channel 110, such that movement intersection 114 along the length of the transverse band 104 is limited in at least one direction.

In some embodiments, the distance between two consecutive outer portions 118 is 20-90 mm. In some embodiments, the distance between two consecutive outer portions 118 is 30-100 mm. In some embodiments, the distance between two consecutive outer portions 118 is 40-60 mm.

Figure 2B:
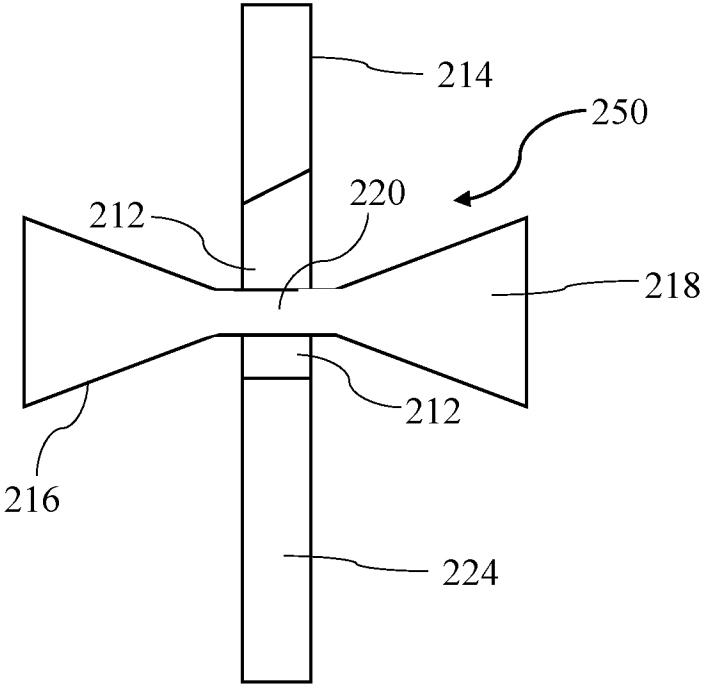
FIGS. 2A and 2B are cross section view simplified illustrations of embodiments of intersections within a net in accordance with some embodiments of the present invention.
Figure 2A:
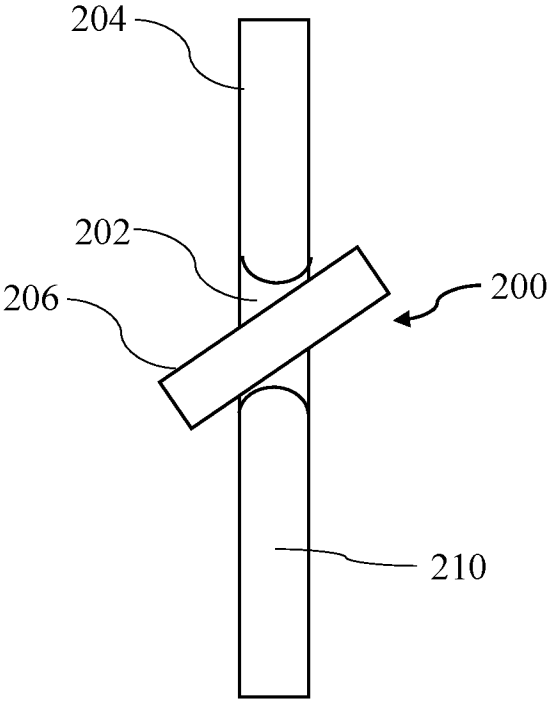

Reference is made to FIGS. 2A and 2B, which are cross section views of exemplary embodiments of intersections within a net in accordance with some embodiments of the present invention. In the exemplary embodiments depicted by FIGS. 2A and 2B, the longitudinal bands 204/214 comprise one film 210/224 on either side of the transverse bands 206/216 at each intersection 200/250.

In some embodiments, such as depicted by FIG. 2A, the channel 202 is shaped to accommodate the transverse band 206. In some embodiments, the channel 202 is shaped to accommodate the transverse band 206 at a range of orientations in relation to the longitudinal band 204.

In some embodiments, such as depicted by FIG. 2B, the width of the transverse band 216 varies. In some embodiments, the width of the portion 220 of the transverse band within the channel 212 is smaller than the width of the channel 212. In some embodiments, the width of the portion 218 of the transverse band 216 outside of the channel 212 is larger than the width of the channel 212. In some embodiments, the distance between the portions 218 of the transverse band 216 which are wider than the channel 212 determined the range of mobility of intersection 250 along the length of the transverse band 216.

In some embodiments, the channel 212 is asymmetrical. In some embodiments, the asymmetrical channel 212 prevents the transverse band 216 from sliding through the channel in only one direction along the length of the transverse band 216.

Intersection

In some embodiments, the net 100 comprises a plurality of intersections 114. In some embodiments, the intersection 114 comprises a first film, e.g. film 112-1, a transverse band 104 and a second film, e.g., 112-2. In some embodiments, the first and second films 112-1 and 112-2 are components of the longitudinal band 102. In some embodiments, at least a portion of the surface of the first film 112 is adhered to at least a portion of the surface of the second film. In some embodiments, one or both of the films 112 comprise sticky sides. In one embodiment, an intersection 114 comprises a transverse band 104 sandwiched between two films 112.

In some embodiments, an intersection 114 comprises a first portion comprising a first film 112, a transverse band 104 and a second film and a second portion comprising a first film 112 and a second film 112 without a transverse band 104. In some embodiments, an intersection 114 comprises 3 regions wherein the first and the third regions comprise the first portion and the second region comprises the second portion. In one embodiment, the second region is sandwiched between the first and third regions.

In some embodiments, the adhesion between the transverse band 104 and each of films 112 of the longitudinal band 102 is such that applying a force above a threshold value to the one of the bands of an intersection 114 changes the orientation of one band in relation to another.

In some embodiments, the adhesion between the transverse band 104 and the one or more of the films 112 of the longitudinal band 102 comprises lateral adhesion.

In some embodiments, the transverse band 104 is slidable within the channel 110. In some embodiments, the location of the intersection 114 along the length of the transverse band 104 is adjustable. In some embodiments, the orientation of the transverse band 104 is adjustable in relation to the channel 110 and/or the longitudinal band 102.

Reticulate Structure

In some embodiments, the net 100 comprises a reticulate structure. In some embodiments, the reticulate structure is symmetrical. In some embodiments, the reticulate structure is a grid or grid-like.

In some embodiments, at least one transverse band 104 is positioned within the channels 110 of the longitudinal bands 102 such that applying a pulling force onto the transverse band 104 reduces one or more of the width, length, or thickness of at least a portion of the net 100. In some embodiments, and as explained in greater detail elsewhere herein, the structure of the net 100 is adjusted to form fittingly wrap a three-dimensional object.

In some embodiments, the length of a diagonal of the net 100 is elongated by changing the position of the point of intersection 114 along the length of one or more transverse bands 104. In some embodiments, of the elongation ability of the net 100 is increased by removing a transverse band 104 from one or more channels 110.

Net Tensioning Control System

Referring now to FIGS. 3A, 3B, 3C and 3D, which are plan view simplified illustrations of a net tensioning control system in accordance with some embodiments of the current invention. In some embodiments and as explained elsewhere herein, a net 300 comprises adhered portions 106 along longitudinal bands 102 one or more transverse bands 104 crossing one or more longitudinal bands 102 from one side of net 300 to another via one or more channels 312, similar to channels 110 described elsewhere herein, in a serpentine or zigzag manner. In some embodiments, net 300 comprises one or more transverse bands 104 which cross an edge-longitudinal-band 304 of net 300 in a serpentine or zigzag manner.

In some cases, net 300 may enclose items having an asymmetrical geometry, bulging and/or protruding portions. Therefore, in some embodiments, net 300 is stretchable at least along a longitudinal axis thereof. However, overstretching may, in some cases, bring about loss of elasticity of the net 300 fibers/bands or even tearing of the net fibers/bands. Hence, in some embodiments, net 300 comprises a net tensioning control system 350 that limits the extent of stretching of net 300 and prevents overstretching and possibly tearing of the net.

In some embodiments, net tensioning control system 350 comprises one or more transverse bands 302 that run through net 300 in a serpentine manner or zigzag manner. In some embodiments, net tensioning control system 350 comprises one or more transverse bands 302 that cross, circle and or surround an edge-longitudinal-band 304 of net 300 in a serpentine or zigzag manner. In some embodiments, band 302 runs through net 300 or cross, circle and or surround an edge-longitudinal-band following other patterns e.g., parallel to the edge or edges of net 300, in a crisscross pattern, a zig-zag pattern (Z-pattern or N-pattern) or any other pattern that is compliant with increasing tension on net 300 over a material being packed.

Figure 3A:
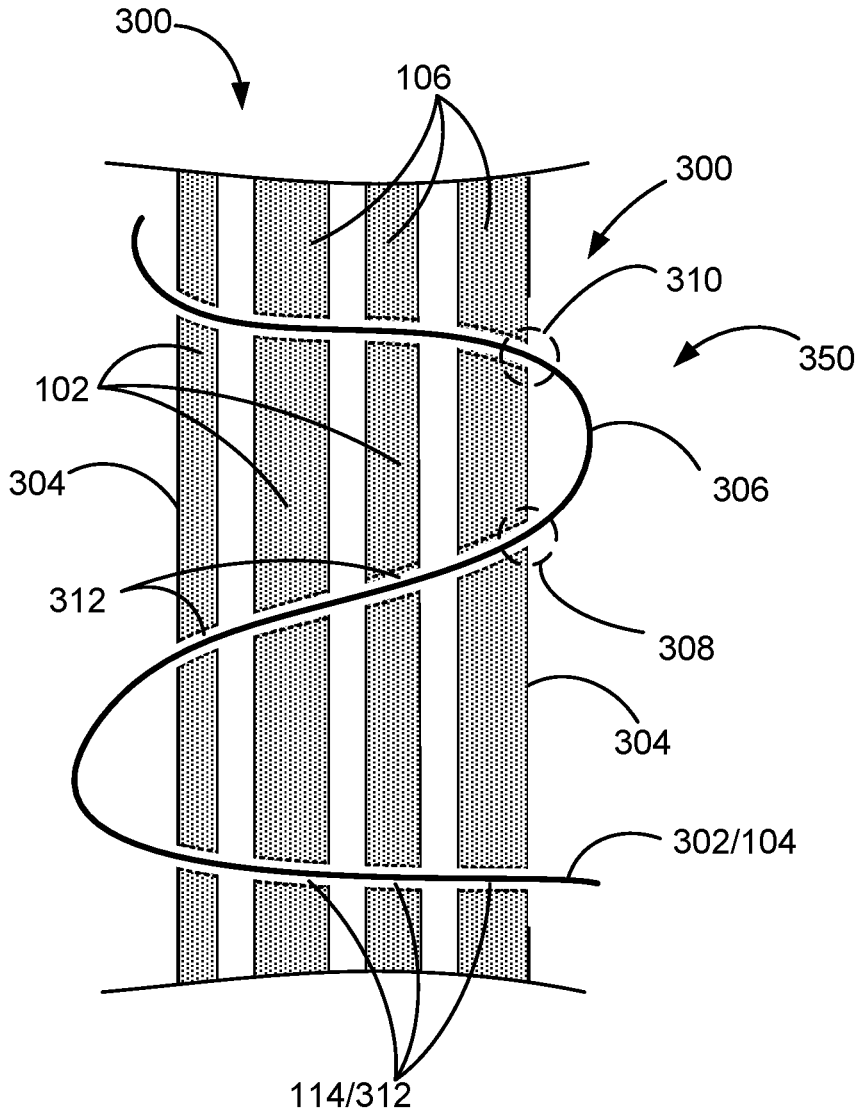
FIGS. 3A to 3E are cross sections of illustrations of embodiments of intersections within a net in accordance with some embodiments of the present invention.
Figure 3C:
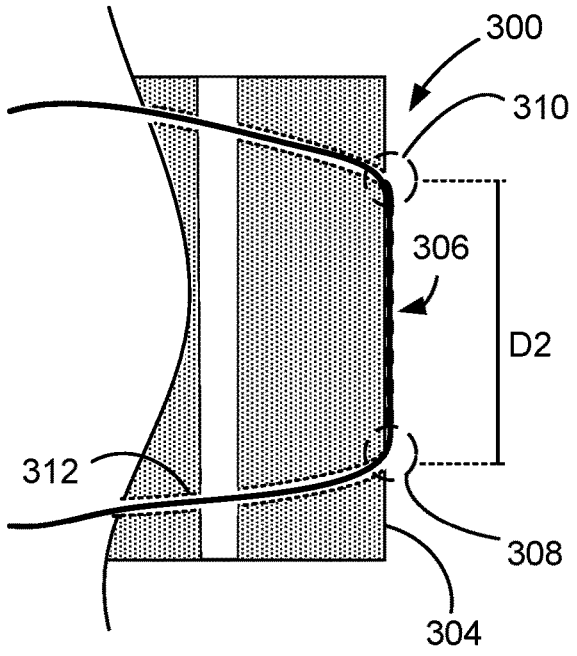

In some embodiments, and as shown in FIG. 3A, transverse band 302 extends beyond the edges 304 of net 300 or an edge-longitudinal-band 304 by exiting and reentering channels 312 at adjustable intersections 114 at one or more edges 304 of net 300 to form one or more semi-loops 306. For example, transverse band 302 may exit at an exit point 308 from a channel 312 and reenter the edge 304 of net 300 via entry point 310 at a second channel 312. In some embodiments, transverse band 302 forms one or more semi-loops 306 at predetermined locations, e.g., at locations disposed to tearing like at folds or bends of net 300. Alternatively, and optionally, transverse band 302 forms semi-loops 306 in a repetitive pattern throughout a dimension e.g., edge, of net 300. In one embodiment, edges 304 is or comprises an edge-longitudinal-band 304.

In some embodiments, transverse band 302 is threaded through net 300, for example, between the films 112 of a band and/or through channels 110 and/or a dedicated channel 312 shaped to have a geometry that corresponds to and supports accommodation of band 302. In some embodiments, transverse band 302 is at least partially adhered to net 300 at one or more locations in dedicated channel e.g., at a junction, an intersection or a crossing as explained in greater detail elsewhere herein. In some embodiments, adherence of transverse band 302 is the same at exit and entry points 308/310 as along adherence points in channels 110 and/or a dedicated channel 312. In some embodiments, adherence of transverse band 302 is greater at entry and exit points 308/310 than the adherence of transverse band 302 along adherence points in channels 110 and/or a dedicated channel 312.

Figure 3B:
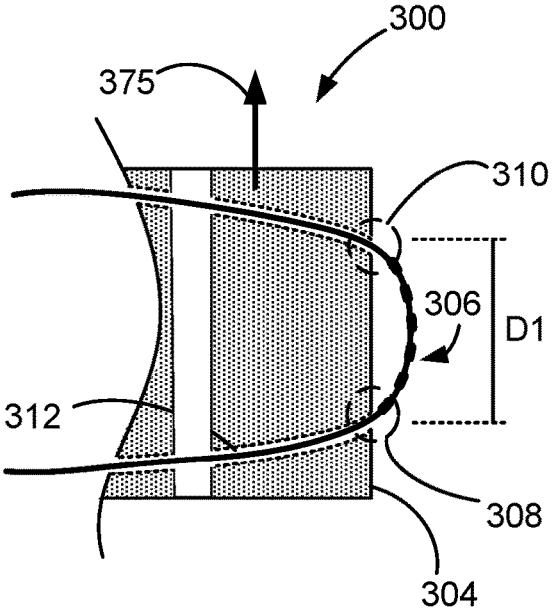

The exemplary embodiments depicted in Figure pair numbers 3B/3C and 3D/3E, transverse band 302 forms a semi-loop 306 having a generally fixed length (L) and protrudes outside one or more edges 304 of net 300 between exit and entry points 308/310 located at a distance (D1) from each other. As illustrated in FIGS. 3B/3C, once net 300 is stretched, for example, in a direction indicated by an arrow designated reference number 375, the distance between exit and entry points 308/310 increases from a distance (D1) to a distance (D2) i.e., (D2)>(D1) as a result of which semi-loop 306, having a generally fixed length (L), is drawn axially and straightens, parallel to the direction indicated by arrow 350 to conform to and be urged along its length against edge 304 of net 300.

In some embodiments, semi-loop 306 serves as a visual indicator of the amount of stretching of net 300 in that the amount of stretching of net 300 corresponds to the level of flatness or proximity of the length dimension of semi-loop 306 to edge 304 of net 100. To that effect, the length (L1) of semi-loop 306 depicted in FIG. 3B is designed to be generally equal to the post-stretching distance (D2) of net 300 between exit and entry points 308/310 (L1=D2). Hence, the length (L) of semi-loop 306 is equal to a maximal allowable distance (D2).

Figure 3E:
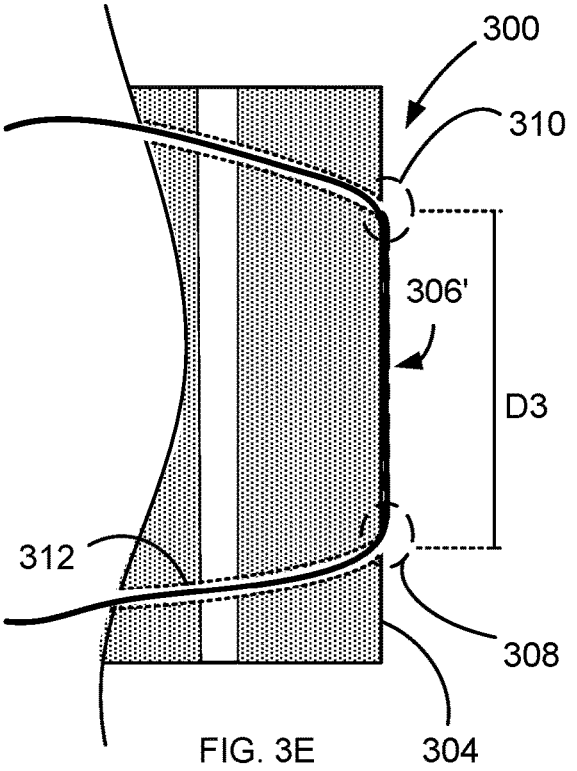
Figure 3D:
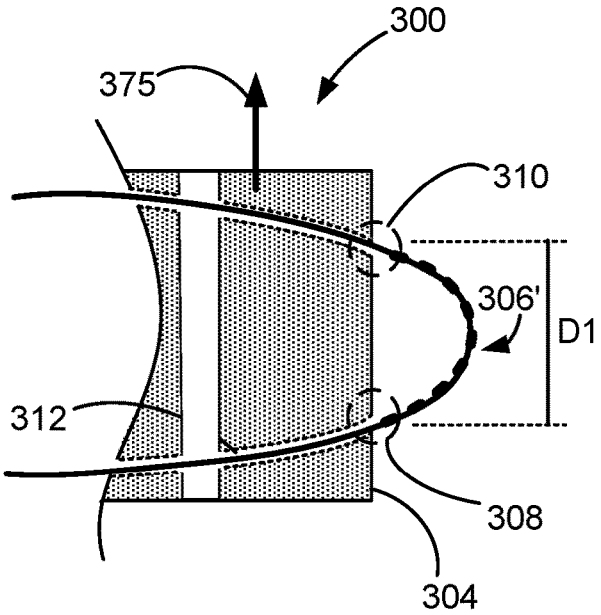

In some embodiments, the length (L) of semi-loop 306 is predetermined in accordance with a desired limit of stretchability of net 300. For example, and as shown in FIGS. 3D and 3E, loop 306' has a length (L2) that allows net 300 to stretch to a limited distance (D3), i.e., (L2=D3) wherein distance (D3) is greater than distance (D2) of FIG. 3C (D3>D2). In this example, (L2/L1) is proportional to (D3/D2).

In some embodiments, during stretching of net 300 there is at least some movement/sliding of transverse band 302 within cannels 110 of adjustable intersections 114 bringing about some distribution of transverse band 302 throughout net 300. This minor distribution of transverse band 302 has negligible if any effect on lengthening of semi-loop 306 along edge 304 of net 300 during stretching.

In some embodiments, the maximal allowable stretchability of net 300 depends on, for example, the material of which longitudinal bands 102 are made, the degree of adhesion of transverse band 104/302 within channels 312 and the density of transverse band 302 crossings. In some embodiments, transverse band 302 is made of a non-compliant material. In some embodiments, transverse band 302 is made of a material less compliant than the material of which net 300 is made e.g., having a Young modulus ($E_{band}$) equal to or smaller than a Young modulus of the net ($E_{net}$). In some embodiments, transverse band 302 is made of an elastic material the elastic limit of which is reached under tensile forces smaller than those required for tearing of the fibers of net 300. In some embodiments, the type of material of transverse band 302 depends on the degree of elasticity of net 300 or the desired degree of stretchability of net 300 regardless of the level of elasticity of transverse and longitudinal bands 104/102 themselves.

Figure 4A:
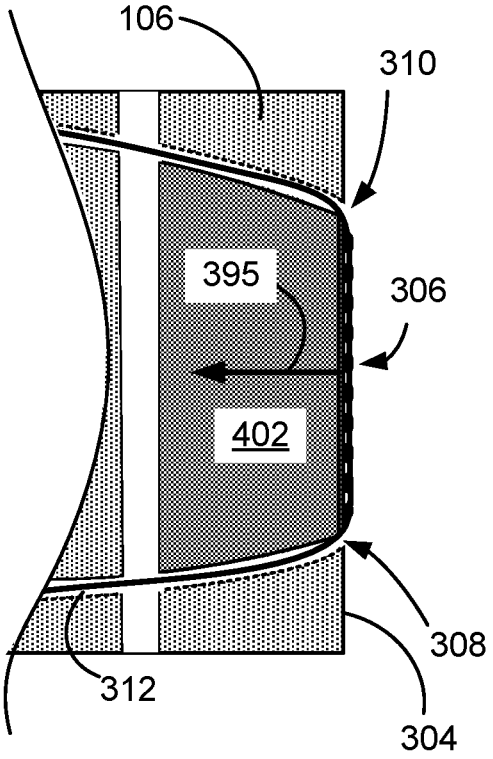
FIGS. 4A and 4B, provide simplified illustrations of the net's tensioning system in accordance with some embodiments of the current invention.
Figure 4B:
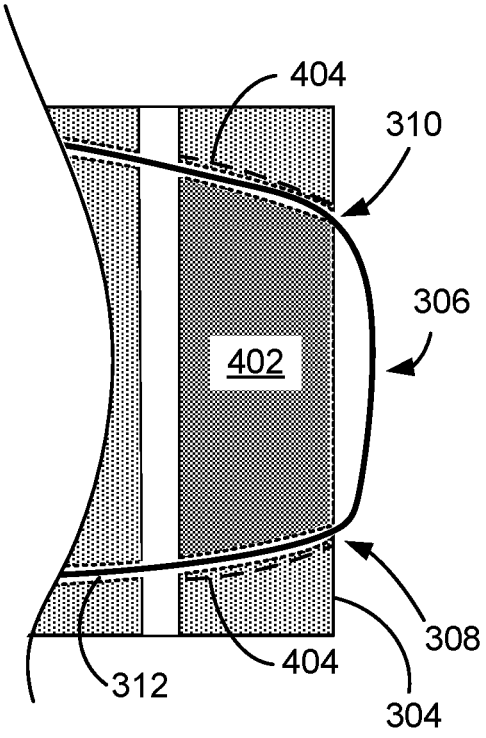

Reference is now made to FIGS. 4A and 4B, which are plan view simplified illustrations of net 300 tensioning system in accordance with some embodiments of the current invention. In some embodiments, semi-loop 306 serves as a physical limiter of overstretching of net 300. As shown in FIG. 4A, net tensioning control system 300 comprises a transverse band 302 semi-loop 306 locking portion 402 along one or more edge longitudinal bands (at the net's longitudinal edge) 106 at one or more edges 304 of net 300 that stops the stretching of transverse band 302 from tearing net 300.

In one embodiment, edges or edge is a longitudinal edge. In one embodiment, an edge or edges comprise a portion of longitudinal bands positioned at the edges or the longitudinal edges of the net. In one embodiment, a net comprises 2 longitudinal edges. In one embodiment, each longitudinal edge comprises at least one longitudinal band. In one embodiment, each longitudinal edge comprises 1 to 10 longitudinal bands. In one embodiment, each longitudinal edge comprises 1 to 6 longitudinal bands. In one embodiment, each longitudinal edge comprises 2 to 4 longitudinal bands. In some embodiments and as explained elsewhere herein, net 300 transverse band 302 is disposed along adherence points in channels 110 and/or dedicated channels 312. In some embodiments, adherence of transverse band 302 within one or more channels 110 and/or a dedicated channel 312 at edge portions of net 300, e.g., along an edge 304 band 106, is stronger than the adherence of transverse and longitudinal bands 104/102 of net 300 at non-edge 304 portions of net 300. This configuration forms a locking portion 402 along one or more edge portions of net 300, disposed between one or more channels 110 and/or a dedicated channel 312. In some embodiments, one or more portions of transverse band 104/302 are coated with an adhesive. In some embodiments, transverse band 104/302 is coated in its entirety with an adhesive. In some embodiments, one or more portions of transverse band 104/302 are welded and/or adhered to one or more longitudinal bands 106.

A potential advantage of this configuration is in that local variation in stretching of net 300 does not affect edges 304 of net 300 e.g., do not bring about tearing of edges 304. A potential advantage of a locking portion 402 is in that when net 300 is tensioned, locking portion 402 stops semi-loop 306 from moving from edges 304 inwards towards the center of net 300 in a direction indicated by arrow 395.

In some embodiments, the ratio between the area (a) of locking portion 402 and the area (b), marked by broken lines 404, which comprises area (a) and includes channels 110 and/or a dedicated channel 312 is (0.1b≥a). The area (b) of net 300 is determined by the density of net 300 longitudinal and transverse bands and not necessarily by the stretchability of net 300.

In some embodiments, one or more portions 402 along edge 304 band 106 may be strengthened by an increase in the density of net 300 the transverse and longitudinal bands 104/102, an added layer of net 300, an added layer of polymer or similar or any other strengthening mechanism.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

In the description and claims of the application, each of the words "comprise" "include" and "have", and forms thereof, are not necessarily limited to members in a list with which the words may be associated. In addition, where there are inconsistencies between this application and any document incorporated by reference, it is hereby intended that the present application controls.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A net, comprising:

a plurality of transverse bands; intersecting a plurality of longitudinal bands;

wherein each longitudinal band of said plurality of longitudinal bands comprises two intermittently adhered films forming channels at discontinuities of adhesion between said films; and wherein at an intersection of a longitudinal band and a transverse band a transverse band is threaded through a channel in said longitudinal band, wherein the strength of the adhesion between said transverse band and said films in said intersection is at least 30% weaker than said adhesion between said films, wherein a position, an orientation, or both of said transverse band in relation to said longitudinal band at said channel is adjustable, wherein said channel is at least partially adhered to said transverse band that is threaded therethrough.

2. The net according to claim 1, wherein at least one channel of said channels is configured to impede movement of said transverse band through said channel.

3. The net according to claim 1, wherein at least one channel of said channels comprises: a semi-adhered zone, a non-adhered zone, a friction zone or a combination thereof between said channel and said transverse bands.

4. The net according to claim 1, wherein at least two of a plurality of transverse bands are threaded through channels of at least two of a plurality of said longitudinal bands and forming four intersections between said longitudinal bands and said transverse bands.

5. The net according to claim 1, wherein: (a) said channel comprises inner surfaces facing each other and wherein the transverse band occupies 20 to 90% of a surface area of said inner surfaces; (b) the ratio between a surface area of adhered portions of said films to a surface area of said films at said channel is at least 3:1; (c) a position and/or orientation of said transverse band in relation to said longitudinal band at said channel is adjustable, or any combination of (a), (b) and (c).

6. The net according to claim 1, wherein a location of the point of intersection between said longitudinal band and said transverse band is adjustable along the length of at least one of said longitudinal bands and/or said transverse bands, wherein adjustability of the net is independent of the elasticity of said transverse bands and said longitudinal bands.

7. The net according to claim 1, wherein said transverse band further crosses an edge longitudinal band in a serpentine or zigzag manner.

8. The net according to claim 7, wherein: (a) said transverse band crosses said edge longitudinal band of said net and forms a semi-loop at one net's longitudinal edge, another net's longitudinal edge, or both; (b) two adjacent segments of said transverse band threaded through at least one said edge longitudinal band, define between them a semi-loop locking portion of said edge longitudinal band; or a combination of (a) and (b).

9. The net according to claim 8, wherein: (a) said semi-loop extends beyond said one net's longitudinal edge, said another net's longitudinal edge, or both; (b) wherein a length (L) of said semi-loop corresponds to a predetermined distance (D) between said intersection of said semi-loop and said edge longitudinal band, at said one net's longitudinal edge, said another net's longitudinal edge, or both, wherein the ratio between an area (A) of said locking portion exclusive of said channels and an area (B) inclusive of said channels is expressed by ($0.1B \geq A$); or a combination of (a) and (b).

10. A net, comprising:

a plurality of transverse bands; intersecting a plurality of longitudinal bands;

wherein each longitudinal band of said plurality of longitudinal bands comprises two intermittently adhered films forming channels at discontinuities of adhesion between said films; and wherein at an intersection of a longitudinal band and a transverse band a transverse band is threaded through a channel in said longitudinal band;

wherein said at least one channel of said channels is configured to impede movement of said at least one transverse band threaded therethrough; and wherein said adhesion between each film of said films within said channel and said transverse band is at least 30% weaker than the adhesion between the adhered films, wherein a position, an orientation, or both of said transverse band in relation to said longitudinal band at said channel is adjustable, wherein said channel is at least partially adhered to said transverse band that is threaded therethrough.

11. The net according to claim 10, wherein said adhesion within at least one channel of said channels comprises: a semi-adhered zone, non-adhered, a friction zone or a combination thereof between said films.

12. The net according to claim 10, wherein at least two of a plurality of transverse bands are threaded through channels of at least two of a plurality of said longitudinal bands and forming four intersections between said longitudinal bands and said transverse bands.

13. The net according to claim 10, wherein: (a) said channel comprises inner surfaces facing each other and wherein said transverse band occupies 20 to 90% of a surface area of said inner surfaces; (b) the ratio between a surface area of adhered portions of said films to a surface area of said films at said channel is at least 3:1; or a combination of (a) and (b).

14. The net according to claim 10, wherein a position and/or orientation of said transverse band in relation to said longitudinal band at said channel is adjustable.

15. The net according to claim 10, wherein a location of the point of intersection between said longitudinal band and said transverse band is adjustable along the length of at least one of said longitudinal bands and/or said transverse bands.

16. The net according to claim 15, wherein adjustability of the net is independent of the elasticity of said transverse bands and said longitudinal bands.

17. The net according to claim 10, wherein said transverse band further crosses an edge longitudinal band in a serpentine or zigzag manner.

18. The net according to claim 17, wherein said transverse band crosses said edge longitudinal band of said net and forms a semi-loop at one net's longitudinal edge, another net's longitudinal edge, or both.

19. The net according to claim 18, wherein: (a) said semi-loop extends beyond said one net's longitudinal edge, said net's longitudinal edge, or both; (b) a length (L) of said semi-loop corresponds to a predetermined distance (D) between said intersection of said semi-loop and at least one said edge longitudinal band at said one net's longitudinal edge, said another net's longitudinal edge, or both; (c) two adjacent segments of said transverse band threaded through said edge longitudinal band, define between them said semi-loop locking portion of said longitudinal band; or any combination of (a), (b) and (c).

20. The net according to claim 19, wherein the ratio between an area (a) of said locking portion exclusive of said channels and an area (b) inclusive of said channels is expressed by ($0.1b \geq a$).

* * * * *